US011732600B2

(12) United States Patent
Hiett et al.

(10) Patent No.: US 11,732,600 B2
(45) Date of Patent: Aug. 22, 2023

(54) GAS TURBINE ENGINE ACTUATION DEVICE

(71) Applicant: General Electric Company, Schenectady, NY (US)

(72) Inventors: David Alexander Hiett, Cincinnati, OH (US); Stefan Joseph Cafaro, Chapel Hill, NC (US); Robert Jon McQuiston, Cincinnati, OH (US); David Marion Ostdiek, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 17/168,800

(22) Filed: Feb. 5, 2021

(65) Prior Publication Data

US 2022/0251966 A1 Aug. 11, 2022

(51) Int. Cl.

| | |
|---|---|
| ***F01D 17/24*** | (2006.01) |
| ***F01D 17/10*** | (2006.01) |
| ***F01D 17/12*** | (2006.01) |
| ***F01D 11/22*** | (2006.01) |
| *F01D 17/26* | (2006.01) |

(52) U.S. Cl.

CPC ..... *F01D 17/105* (2013.01); *F01D 11/22* (2013.01); *F01D 17/12* (2013.01); *F01D 17/24* (2013.01); *F01D 17/26* (2013.01); *F05D 2220/32* (2013.01); *F05D 2240/11* (2013.01); *F05D 2240/12* (2013.01); *F05D 2260/406* (2013.01)

(58) Field of Classification Search

CPC .... F01D 17/24; F01D 17/26; F01D 11/08–24; F05D 2270/62; F05D 2270/64; F02C 7/36

See application file for complete search history.

(56) References Cited

U.S. PATENT DOCUMENTS

| | | | | |
|---|---|---|---|---|
| 8,950,724 | B2 | 2/2015 | Hurst et al. | |
| 9,016,068 | B2 | 4/2015 | Martin et al. | |
| 9,394,829 | B2 | 7/2016 | Cabeen et al. | |
| 10,054,008 | B2 | 8/2018 | Bettagere et al. | |
| 10,364,750 | B2 | 7/2019 | Rambo | |
| 2005/0147492 | A1* | 7/2005 | Mahoney | F02C 9/54 415/148 |
| 2006/0226285 | A1* | 10/2006 | Matsui | B64C 13/504 244/99.6 |

(Continued)

FOREIGN PATENT DOCUMENTS

| | | | |
|---|---|---|---|
| EP | 2872762 | A1 | 5/2015 |
| EP | 3722570 | A1 | 10/2020 |
| GB | 2497934 | A | 7/2013 |

*Primary Examiner* — J. Todd Newton
*Assistant Examiner* — Behnoush Haghighian
(74) *Attorney, Agent, or Firm* — Dority & Manning, P.A.

(57) ABSTRACT

A gas turbine engine actuation system includes a gas turbine engine, an actuation device, an actuator, and a power source. The gas turbine engine includes a compressor section, a combustion section, a turbine section, and a rotating shaft. The actuation device is operable with the compressor section, combustion section, turbine section, or a combination thereof. The actuator is operationally coupled to the actuation device and includes an electric actuator configured to convert electrical current into mechanical power. The power source is configured to supply electrical current to the actuator, alone or in tandem with a hydraulic actuator.

15 Claims, 6 Drawing Sheets

(56) References Cited

U.S. PATENT DOCUMENTS

| | | | | |
|---|---|---|---|---|
| 2010/0116929 | A1* | 5/2010 | Hejda | F15B 15/088 244/99.3 |
| 2011/0174921 | A1* | 7/2011 | Fervel | B64C 9/02 244/99.2 |
| 2014/0060079 | A1 | 3/2014 | Foster | |
| 2016/0230585 | A1* | 8/2016 | Arnold | F02B 37/025 |
| 2019/0211702 | A1* | 7/2019 | Vonfelt | F02C 9/20 |
| 2020/0123926 | A1* | 4/2020 | Amari | G05B 13/024 |
| 2020/0325827 | A1 | 10/2020 | Bewick et al. | |

* cited by examiner

GAS TURBINE ENGINE ACTUATION DEVICE

FIELD

The present disclosure relates to an actuation system of a gas turbine engine.

BACKGROUND

A gas turbine engine generally includes a turbomachine and a rotor assembly. Gas turbine engines, such as turbofan engines, may be used for aircraft propulsion. In the case of a turbofan engine, the rotor assembly may be configured as a fan assembly. A fan assembly may include one or more components having variable geometries that can be manipulated by means of valves and actuators. For instance, the geometries of these components may be varied to control surge and rotating stall.

In existing gas turbine engines, valves and actuators are typically controlled using actuation fluid, such as fuel, to operate each actuator or valve. In a traditional hydraulic actuation system, it may be difficult to control the actuators or valves in certain conditions. For instance, the hydraulic fluid is typically driven by a source pressure, which may be insufficient or lost altogether in extreme operating conditions. Accordingly, an improved actuation device would be useful.

BRIEF DESCRIPTION

Aspects and advantages of the disclosure will be set forth in part in the following description, or may be obvious from the description, or may be learned through practice of the disclosure.

In one exemplary embodiment of the present disclosure, a gas turbine engine actuation system includes a gas turbine engine, an actuation device, an actuator, and a power source. The gas turbine engine includes a compressor section, a combustion section, a turbine section, and a rotating shaft. The actuation device is operable with the compressor section, combustion section, turbine section, or a combination thereof. The actuator is operationally coupled to the actuation device and includes an electric actuator configured to convert electrical current into mechanical power. The power source is configured to supply electrical current to the actuator.

In one exemplary embodiment of the present disclosure, a hybrid electric/hydraulic actuation system for a gas turbine engine includes an actuation device operable with a section of the gas turbine engine, a hybrid electric/hydraulic actuator, a hydraulic actuation system, and an electric actuation system. The hybrid electric/hydraulic actuator is operationally coupled to the actuation device and is driven partially by electrical power and partially by a working fluid. As used in this context, driven partially means the actuator can be driven by electrical power all or some of the time, can be driven by the working fluid all or some of the time, and/or can be driven at least some of the time by a combination of electrical power and motive force generated by the working fluid. The hydraulic actuation system includes the working fluid, the working fluid pump disposed to pressurize the hydraulic actuation system with the working fluid, and a fluid line that is fluidly connected to and extending between the working fluid pump and the hybrid electric/hydraulic actuator. The electric actuation system includes a power source configured to supply electrical current to the hybrid electric/hydraulic actuator.

In one exemplary embodiment of the present disclosure, a method of changing a position of an actuation device in a gas turbine engine includes providing a hydraulic motive force to an actuator operationally coupled to the actuation device to move the actuation device from a first position to a second position. Data indicative of the hydraulic motive force being less than an amount necessary to move the actuation device from the first position to the second position is received. Electric power is provided to the actuator to assist with moving the actuation device from the first position to the second position.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure of the present disclosure, including the best mode thereof, directed to one of ordinary skill in the art, is set forth in the specification, which makes reference to the appended figures, in which.

DETAILED DESCRIPTION

Figure 1A:
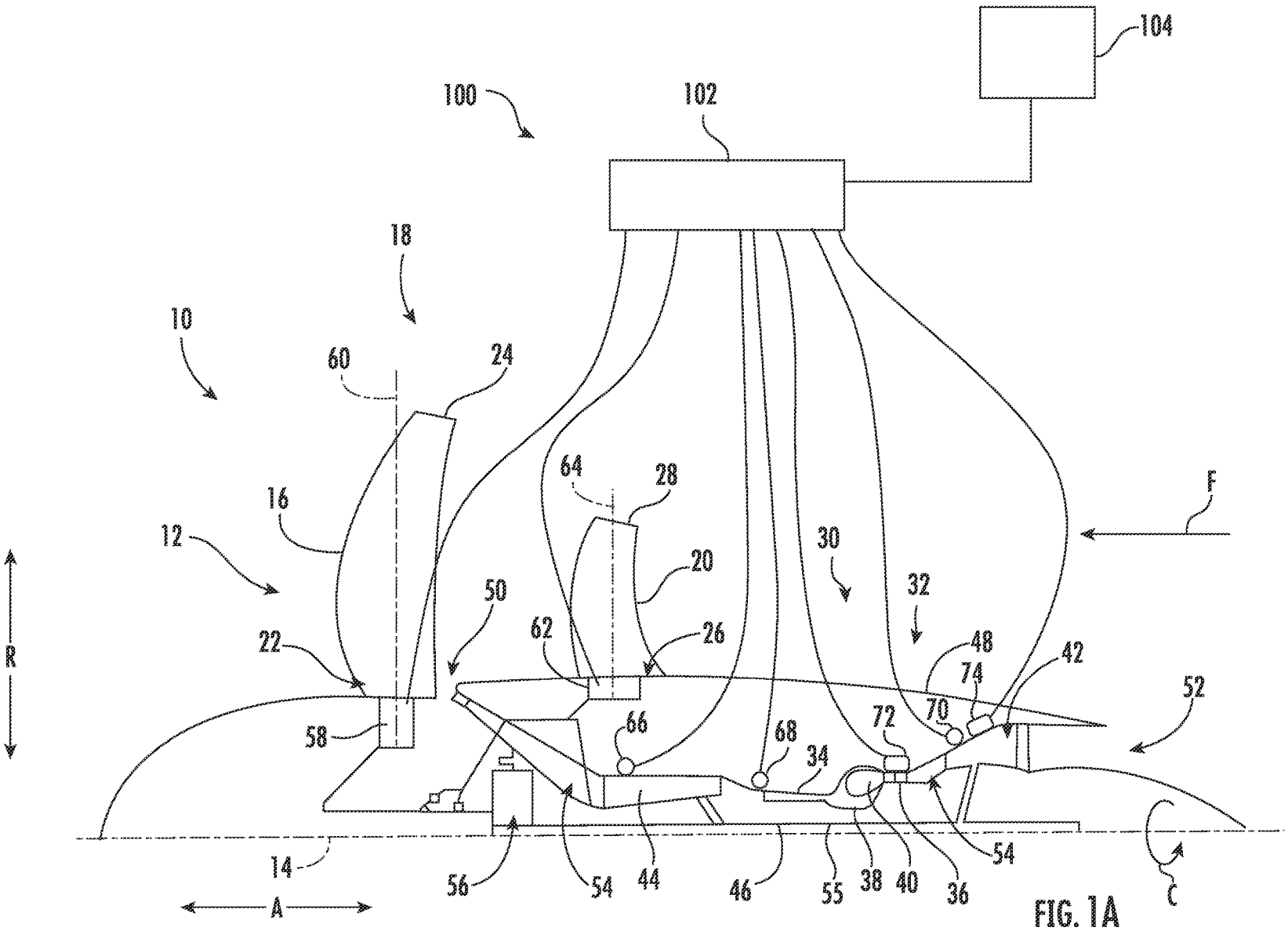
FIG. 1A is a schematic, cross-sectional view of a first gas turbine engine with an electric power system in accordance with an exemplary embodiment of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "coupled," "fixed," "attached to," and the like refer to both direct coupling, fixing, or attaching, as well as indirect coupling, fixing, or attaching through one or more intermediate components or features, unless otherwise specified herein.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 1, 2, 4, 10, 15, or 20 percent margin. These approximating margins may apply to a single value, either or both endpoints defining numerical ranges, and/or the margin for ranges between endpoints.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

In hydraulic actuations systems, the ability to provide a motive force to move an actuation device is driven by a source pressure. As mentioned above, in some hydraulic actuation systems, the hydraulic fluid may be fuel. When such is the case, the fuel is provided via a fuel pump, which generates a source pressure that is directly related to an amount of fuel requested or needed by the gas turbine engine. During, for example, a rejected takeoff event or other event reducing an output power of the gas turbine engine, a fuel pressure may drop rapidly and can lead to a scenario where the motive force from the fuel system to drive the actuator and move the actuation device is less than the aerodynamic forces acting on the actuation device. For example, when the actuation device is a variable bleed valve door or variable stator vane, the aerodynamic forces acting on these components may be greater than the motive force available from the fuel system to move these components. In such an instance, the variable bleed valves can be prevented from opening at a desired rate, and the variable stator vanes can be prevented from moving to a desired position, putting a compressor of the gas turbine engine at risk of stall.

Embodiments in the present disclosure propose using a hybrid electric/hydraulic system of generators on the low pressure shaft and/or the high pressure shaft of a multi-shaft turbofan engine (and/or an external battery or power source). The hybrid electric generator system is used to: drive an electric system of actuators; provide boost power to valves and actuators at extreme operating conditions; and/or provide backup power to a hybrid hydraulic/electric actuator in the event of loss of hydraulic pressure. The hybrid hydraulic/electric system has a combination of hydraulic and electric sources to draw power from to always provide the power needed to drive the actuation system(s). Benefits of the proposed hybrid electric/hydraulic system of generators include the electric power load being more consistent in situations where the aerodynamic forces acting against actuator movement are high compared to available hydraulic power as well as a reduction of hydraulic fluid plumbing lines which reduces the complexity and the weight of the engine architecture.

Referring now to FIG. 1A, a cross-sectional view of an exemplary embodiment of a gas turbine engine as may incorporate one or more inventive aspects of the present disclosure is provided. In particular, the exemplary gas turbine engine of FIG. 1A is a configured as a single unducted rotor engine 10 defining axial direction A, radial direction R, and circumferential direction C. As is seen from FIG. 1A, engine 10 takes the form of an open rotor propulsion system and has a rotor assembly 12 which includes an array of airfoils arranged around a centerline 14 of engine 10, and more particularly includes an array of rotor blades 16 arranged around the central longitudinal axis 14 of engine 10.

Moreover, as will be explained in more detail below, engine 10 additionally includes a non-rotating vane assembly 18 positioned aft of rotor assembly 12 (i.e., non-rotating with respect to the central axis 14), which includes an array of airfoils also disposed around central axis 14, and more particularly includes an array of vanes 20 disposed around central axis 14. The rotor blades 16 are arranged in typically equally spaced relation around the centerline 14, and each blade has a root 22 and a tip 24 and a span defined therebetween. Similarly, the vanes 20 are also arranged in typically equally spaced relation around the centerline 14, and each has a root 26 and a tip 28 and a span defined therebetween. Rotor assembly 12 further includes a hub located forward of the plurality of rotor blades 16.

Additionally, engine 10 includes a turbomachine 30 having a core (or high pressure/high speed system) 32 and a low pressure/low speed system. It will be appreciated that as used herein, the terms "speed" and "pressure" are used with respect to the high pressure/high speed system and low pressure/low speed system interchangeably. Further, it will be appreciated that the terms "high" and "low" are used in this same context to distinguish the two systems, and are not meant to imply any absolute speed and/or pressure values.

The core 32 generally includes a high-speed compressor 34, a high speed turbine 36, and a high speed shaft 38 extending therebetween and connecting the high speed compressor 34 and high speed turbine 36. The high speed compressor 34, the high speed turbine 36, and the high speed shaft 38 may collectively be referred to as a high speed spool of the engine. Further, a combustion section 40 is located between the high speed compressor 34 and high speed turbine 36. The combustion section 40 may include one or more configurations for receiving a mixture of fuel and air, and providing a flow of combustion gasses through the high speed turbine 36 for driving the high speed spool.

The low speed system similarly includes a low speed turbine 42, a low speed or low pressure compressor or booster, 44, and a low speed shaft 46 extending between and connecting the low speed compressor 44 and low speed turbine 42. The low speed compressor 44, the low speed turbine 42, and the low speed shaft 46 may collectively be referred to as a low speed spool 55 of the engine. Although engine 10 is depicted with the low speed compressor 44 positioned forward of the high speed compressor 34, in certain embodiments the compressors 34, 44 may be in an interdigitated arrangement. Additionally, or alternatively, although engine 10 is depicted with the high speed turbine 36 positioned forward of the low speed turbine 42, in certain embodiments the turbines 36, 42 may similarly be in an interdigitated arrangement.

Referring still to FIG. 1A, the turbomachine 30 is generally encased in a cowl 48. Moreover, it will be appreciated that the cowl 48 defines at least in part an inlet 50 and an exhaust 52, and includes a turbomachinery flowpath 54 extending between the inlet 50 and the exhaust 52. The inlet 50 is for the embodiment shown an annular or axisymmetric 360 degree inlet 50 located between the rotor blade assembly 12 and the fixed or stationary vane assembly 18, and provides a path for incoming atmospheric air to enter the turbomachinery flowpath 54 (and compressors 44, 34, combustion section 40, and turbines 36, 42) inwardly of the guide vanes 28 along the radial direction R. Such a location may be advantageous for a variety of reasons, including management of icing performance as well as protecting the inlet 50 from various objects and materials as may be encountered in operation. However, in other embodiments, the inlet 50 may be positioned at any other suitable location, e.g., aft of vane assembly 18, arranged in a non-axisymmetric manner, etc.

As is depicted, rotor assembly 12 is driven by the turbomachine 30, and more specifically, is driven by the low speed spool 55. More specifically, still, engine 10 in the embodiment shown in FIG. 1A includes a power gearbox 56, and rotor assembly 12 is driven by the low speed spool 55 of the turbomachine 30 across the power gearbox 56. In such a manner, the rotating rotor blades 16 of rotor assembly 12 may rotate around the axis 14 and generate thrust to propel engine 10, and hence an aircraft to which it is associated, in a forward direction F. The power gearbox 56 may include a gearset for decreasing a rotational speed of the low speed spool 55 relative to the low speed turbine 42, such that rotor assembly 12 may rotate at a slower rotational speed than the low speed spool 55.

As briefly mentioned above engine 10 includes a vane assembly 18. Vane assembly 18 extends from the cowl 48 and is positioned aft of rotor assembly 12. The vanes 20 of vane assembly 18 may be mounted to a stationary frame or other mounting structure and do not rotate relative to the central axis 14. For reference purposes, FIG. 1A also depicts the forward direction with arrow F, which in turn defines the forward and aft portions of the system. As shown in FIG. 1A, rotor assembly 12 is located forward of the turbomachine 30 in a "puller" configuration, and the exhaust 52 is located aft of the guide vanes 28. As will be appreciated, the vanes 20 of vane assembly 18 may be configured for straightening out an airflow (e.g., reducing a swirl in the airflow) from rotor assembly 12 to increase an efficiency of engine 10. For example, the vanes 20 may be sized, shaped, and configured to impart a counteracting swirl to the airflow from the rotor blades 16 so that in a downstream direction aft of both rows of airfoils (e.g., blades 16, vanes 20) the airflow has a greatly reduced degree of swirl, which may translate to an increased level of induced efficiency.

Referring still to FIG. 1A, it may be desirable that the rotor blades 16, the vanes 20, or both, incorporate a pitch change mechanism such that the airfoils (e.g., blades 16, vanes 20, etc.) can be rotated with respect to an axis of pitch rotation either independently or in conjunction with one another. Such pitch change can be utilized to vary thrust and/or swirl effects under various operating conditions, including to adjust a magnitude or direction of thrust produced at the rotor blades 16, or to provide a thrust reversing feature which may be useful in certain operating conditions such as upon landing an aircraft, or to desirably adjust acoustic noise produced at least in part by the rotor blades 16, the vanes 20, or aerodynamic interactions from the rotor blades 16 relative to the vanes 20. More specifically, for the embodiment of FIG. 1A, rotor assembly 12 is depicted with an actuator 58. In this example, actuator 58 is a pitch change mechanism for rotating the rotor blades 16 about their respective pitch axes 60. Vane assembly 18 is depicted with actuator 62, which in this example is a pitch change mechanism for rotating the vanes 20 about their respective pitch axes 64.

Figure 1B:
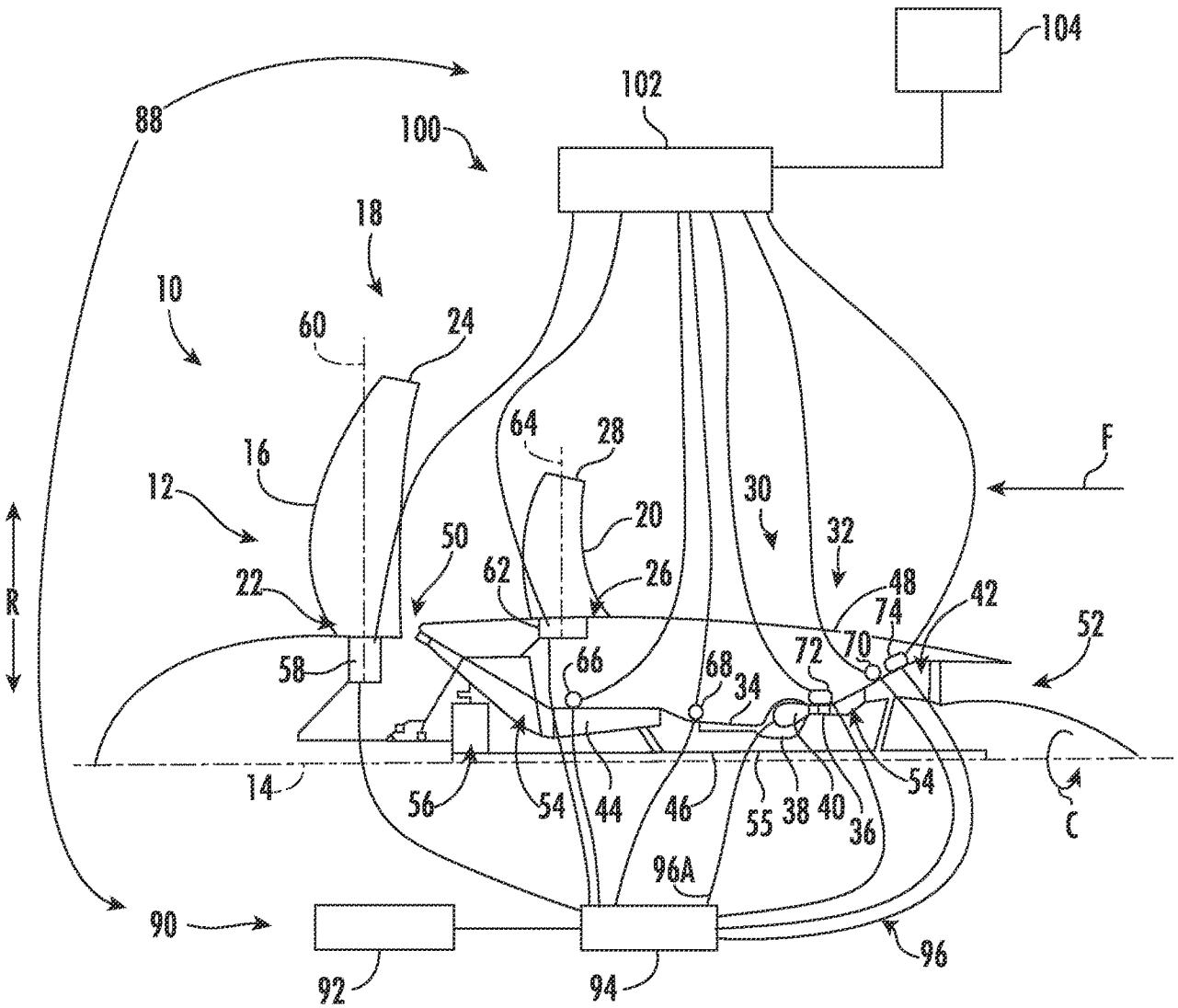
FIG. 1B is a schematic, cross-sectional view of the first gas turbine engine with a hybrid electric/hydraulic power system in accordance with an exemplary embodiment of the present disclosure.

Actuators 66, 68, and 70 are also included in the embodiment shown in FIG. 1A (and in FIG. 1B). In one example, each of actuators 58, 62, 66, 68, and 70 individually represents a combination of an actuation device and an actuator to drive movement of the actuation device. The actuation devices, represented by actuators 66, 68, and 70, in FIG. 1A can include one or more of variable bleed valves, variable stator vanes, variable inlet guide vanes, variable outlet guide vanes, compressor discharge pressure bleed valves, a turbine clearance control systems, recycle valves, bleed valves, and throttle valves. In such a manner, it will be appreciated that the actuation devices may generally be any variable geometry component of the engine 10 for modifying an airflow through the turbomachinery flowpath 54 or around the turbomachine 30, or airflow valve of the engine 10 for modifying an amount of airflow bled from the turbomachinery flowpath 54 or an airflow over the turbomachine 30 or provided to the turbomachinery flowpath 54 or an airflow over the turbomachine 30.

Referring still to FIG. 1A, generator 72 and generator 74 are shown mounted to engine 10. In particular, generator 72 can be a high speed generator mounted to high speed turbine 36 (e.g., the high pressure turbine). Generator 74 can be a low speed generator mounted to low speed turbine 42 (e.g., the low pressure turbine).

It will be appreciated, however, that the exemplary single rotor unducted engine 10 depicted in FIG. 1A is by way of example only, and that in other exemplary embodiments, engine 10 may have any other suitable configuration, including, for example, any other suitable number of shafts or spools, turbines, compressors, etc.; fixed-pitch blades 16, 20, or both; a direct-drive configuration (i.e., may not include the gearbox 56); etc. For example, in other exemplary embodiments, engine 10 may be a three-spool engine, having an intermediate speed compressor and/or turbine. In such a configuration, it will be appreciated that the terms "high" and "low," as used herein with respect to the speed and/or pressure of a turbine, compressor, or spool are terms of convenience to differentiate between the components, but do not require any specific relative speeds and/or pressures, and are not exclusive of additional compressors, turbines, and/or spools or shafts.

Additionally, or alternatively, in other exemplary embodiments, any other suitable gas turbine engine may be provided. For example, in other exemplary embodiments, the gas turbine engine may be a turboshaft engine, a turboprop engine, turbojet engine, etc. Moreover, for example, although the engine is depicted as a single unducted rotor engine, in other embodiments, the engine may include a multi-stage open rotor configuration, and aspects of the disclosure described hereinbelow may be incorporated therein. Further, still, in other exemplary embodiments, engine 10 may be configured as a ducted turbofan engine (see e.g., FIGS. 2A-2B).

With respect to FIG. 1A, it will be appreciated that the engine is integrated with an electric actuation system 100. Electric actuation system 100 generally includes a load sharing bank 102 and a power source 104. Further, for the embodiment shown, load sharing bank 102 of electric actuation system 100 is in electrical communication with power source 104 and with actuators 58, 62, 66, 68, and 70. In this example, actuators 58, 62, 66, 68, and 70 and generators 72 and 74 can be consider parts of electric actuation system 100.

The load sharing back 102 may generally be any device capable of receiving electric power and distributing such electric power in a desired manner. For example, the load sharing bank 102 may include an electric controller, power electronics, switches, etc. to perform such functionality. Additionally, in certain embodiments, the load sharing bank may further store some electric power, acting as an electric energy storage unit.

Notably, although a single load sharing bank 102 is provided in the embodiment of FIG. 1B, in alternative exemplary embodiments, the electric actuation system 100 may additionally or alternatively include a plurality of load sharing banks, such as a plurality of electric controllers, such that one or more of the actuators are provided electric power from separate load sharing banks.

In at least certain exemplary embodiments, power source 104 may include one or more batteries. Additionally, or alternatively, power source 104 may include one or more supercapacitor arrays, one or more ultracapacitor arrays, or both. Additionally, or alternatively still, the power source 104 may be one or both of the generators 72, 74, or further may be a generator driven by a separate gas turbine engine (e.g., a thrust producing gas turbine engine or an auxiliary power unit).

In at least certain embodiments, power source 104 may be configured to provide at least 5 kilowatts (kW) of energy to electric actuation system 100, such as at least 50 kW, such as at least 50 kW, such as at least 250 kW, such as at least 300 kW, such as at least 350 kW, such as at least 400 kW, such as at least 500 kW, such as up to 5 megawatts (MW), such as up to 10 megawatts (MW). Further, power source 104 may be configured to provide such electrical power for at least two minutes, such as at least three minutes, such as at least five minutes, such as up to an hour. Further, still, in other embodiments, power source 104 may be configured to provide such electrical power for any other suitable duration, such as continuously during operation of the engine 10.

During a rejected takeoff event, engine 10 is rapidly decelerated to idle from takeoff power along at an extreme rate. This presents a challenge to the stability margin of low speed compressor 44. During the rejected takeoff event, it is desired to open a variable bleed valve (e.g., the actuation device represented by actuator 66) as rapidly as possible to prevent stall of low speed compressor 44.

In existing hydraulic actuation systems, the hydraulic working fluid is typically driven by a source pressure. In the case of a fuel-based hydraulic system, the fuel is provided via a fuel pump and the source pressure is directly related to an amount of fuel provided to the combustion section 40 of the engine 10. During, for example, the rejected takeoff event or other event reducing an output power of the engine 10, a fuel pressure may drop rapidly and can lead to a scenario where the motive force from the fuel system to drive the actuator and move the actuation device is less than the aerodynamic forces acting on the actuation device. For example, when the actuation device is a variable bleed valve door or a variable stator vane, the aerodynamic forces acting on these components may be greater than the motive force available from the fuel system to move these components. In such an instance, the variable bleed valves can be prevented from opening at a desired rate, and the variable stator vanes can be prevented from moving to a desired position, putting a compressor of the gas turbine engine at risk of stall.

In an all-electric version of an actuation system as presented in FIG. 1A (and FIG. 2A, discussed below), it will be appreciated that when, for example, a rejected takeoff flag is tripped or other data indicative of a rejected takeoff is received, electric actuation system 100 may be activated and deployed to provide a desired motive force to the actuators (e.g., actuators 66, 68, 70) to move the actuation devices of these actuators in a desired manner. Continuing the example, the electric actuation system 100 may power a maximum rate of opening the variable bleed valve doors of, e.g., actuator 66. Electric actuation system 100 in this case determines or acts upon a determination of the maximum electric load required, and the load sharing bank 102 provides such power to the actuators.

Some of the benefits of electric actuation system 100 can include a reduction or elimination of hydraulic fluid plumbing lines in engine 10 thereby reducing the complexity and weight of the architecture of engine 10. With electric actuation system 100, the resultant electric power load is more consistent in situations where the aerodynamic forces acting against movement of any of actuators 58, 62, or 66-70 are high compared to available hydraulic power. Additionally, slew rates of fuel hydraulic actuators can be limited by the available power of the supply pump of the hydraulic system. With electric actuation system 100, faster slew rates can be achieved by drawing electric power from the turbines via generators 72 or 74 or from an external source (e.g., power source 104).

In other embodiments, engine 10 may include a third flowpath or third stream extending from either low speed compressor 44 or high speed compressor 34. A "third stream" as used herein means a secondary air stream capable of increasing fluid energy to produce a minority of total propulsion system thrust. A pressure ratio of the third stream is higher than that of the primary propulsion stream (e.g., a bypass or propeller driven propulsion stream). The thrust may be produced through a dedicated nozzle or through mixing of the secondary air stream with the primary propulsion stream or a core air stream, e.g., into a common nozzle. In certain exemplary embodiments an operating temperature of the secondary air stream is less than a maximum compressor discharge temperature for the engine, and more specifically may be less than 350 degrees Fahrenheit (such as less than 300 degrees Fahrenheit, such as less than 250 degrees Fahrenheit, such as less than 200 degrees Fahrenheit, and at least as great as an ambient temperature).

In certain exemplary embodiments these operating temperatures may facilitate heat transfer to or from the secondary air stream and a separate fluid stream. Further, in certain exemplary embodiments, the secondary air stream may contribute less than 50% of the total engine thrust (and at least, e.g., 2% of the total engine thrust) at a takeoff condition, or more particularly while operating at a rated takeoff power at sea level, static flight speed, 86 degree Fahrenheit ambient temperature operating conditions. Furthermore in certain exemplary embodiments, aspects of the secondary air stream (e.g., airstream, mixing, or exhaust properties), and thereby the aforementioned exemplary percent contribution to total thrust, may passively adjust during engine operation or be modified purposefully through use of engine control features (such as fuel flow, electric machine power, variable stators, variable inlet guide vanes, valves, variable exhaust geometry, or fluidic features) to adjust or optimize overall system performance across a broad range of potential operating conditions.

Referring now to FIG. 1B, FIG. 1B is a schematic, cross-sectional view of engine 10 with a hybrid electric/hydraulic power system 88. The exemplary embodiment of FIG. 1B may be configured in substantially the same manner as the exemplary engine 10 described above with respect to FIG. 1A, and the same or similar reference numerals may refer to the same or similar parts. In the embodiment shown in FIG. 1B, engine 10 is shown to include hybrid electric/hydraulic actuation system 88 including both electric actuation system 100 (with load sharing bank 102 and a power source 104) and hydraulic actuation system 90 (with accessory gear box 92 (AGB 92), working fluid pump 94, and fluid lines 96).

Here, hydraulic actuation system 90 combines with electric actuation system 100 to form hybrid electric/hydraulic power system 88. With hybrid electric/hydraulic power system 88, both of hydraulic actuation system 90 and electric actuation system 100 are configured to drive, alone or in tandem, actuators 58, 62, and 66-70 of engine 10. For example, working fluid pump 94 of hydraulic actuation system 90 is fluidly connected to each of actuators 58, 62, and 66-70 via fluid lines 96. In this way, working fluid pump 94 is configured to deliver a working fluid to each of actuators 58, 62, and 66-70 so as to drive actuation of each of actuators 58, 62, and 66-70. In this example, working fluid pump 94 is driven by AGB 92 of engine 10. However, in other embodiments, the working fluid pump 94 may be driven by any other power source, such as an electric power source.

In one example, and more particularly, in the example depicted in FIG. 1B, the hydraulic actuation system 90 is configured as part of a fuel delivery system. As such, for the embodiment shown, the hydraulic actuation system 90 further includes a fuel line 96A extending to the combustion section 40 to provide a flow of fuel to the combustion section 40. During operation of hybrid electric/hydraulic power system 88, electric actuation system 100 would provide an electric boost to hydraulic actuation system 90 during at least certain operations. For example, when the fuel pressure drops, hybrid electric/hydraulic actuation system 88 may provide supplemental electric power via electric actuation system 100 to facilitate moving the various actuation devices between a first and second position, despite a relatively low hydraulic pressure/fuel pressure. For example, in such a scenario, the hybrid electric/hydraulic actuation system 88 may provide supplemental electric power via electric actuation system 100 to maximize the opening rate of the actuation device of actuator 66 (e.g., a variable bleed valve) and/or of any of the other actuators 58, 62, 70, or 68. Additionally, an ability of hybrid electric/hydraulic actuation system 88 to determine which shaft to pull power from has the added benefit of modifying the rate of deceleration during a rejected takeoff event which provides additional time for hybrid electric/hydraulic actuation system 88 to open the e.g., the variable bleed valves or modify other variable geometry components (e.g., any of actuators 58, 62, 66, 68, or 70).

An additional benefit of hybrid electric/hydraulic actuation system 88 is the creation of a layer of redundancy against failure of either of electric actuation system 100 or hydraulic actuation system 90. If one of the two systems fails, the other can then take over to supply the necessary power to actuators 58, 62, and/or 66-70. In other examples, one operational mode could have electric actuation system 100 providing less than 100% power and hydraulic actuation system 90 providing less than 100% power to actuators 58, 62, and/or 66-70. For example, the electric actuation system 100, hydraulic actuation system 90, or both may provide between 10% and 90%, such as between 25% and 75% of the power to the actuators. In another example, each of electric actuation system 100 and hydraulic actuation system 90 can provide up to 100% power to actuators 58, 62, and/or 66-70 at different time periods (or at the same time).

Figure 2A:
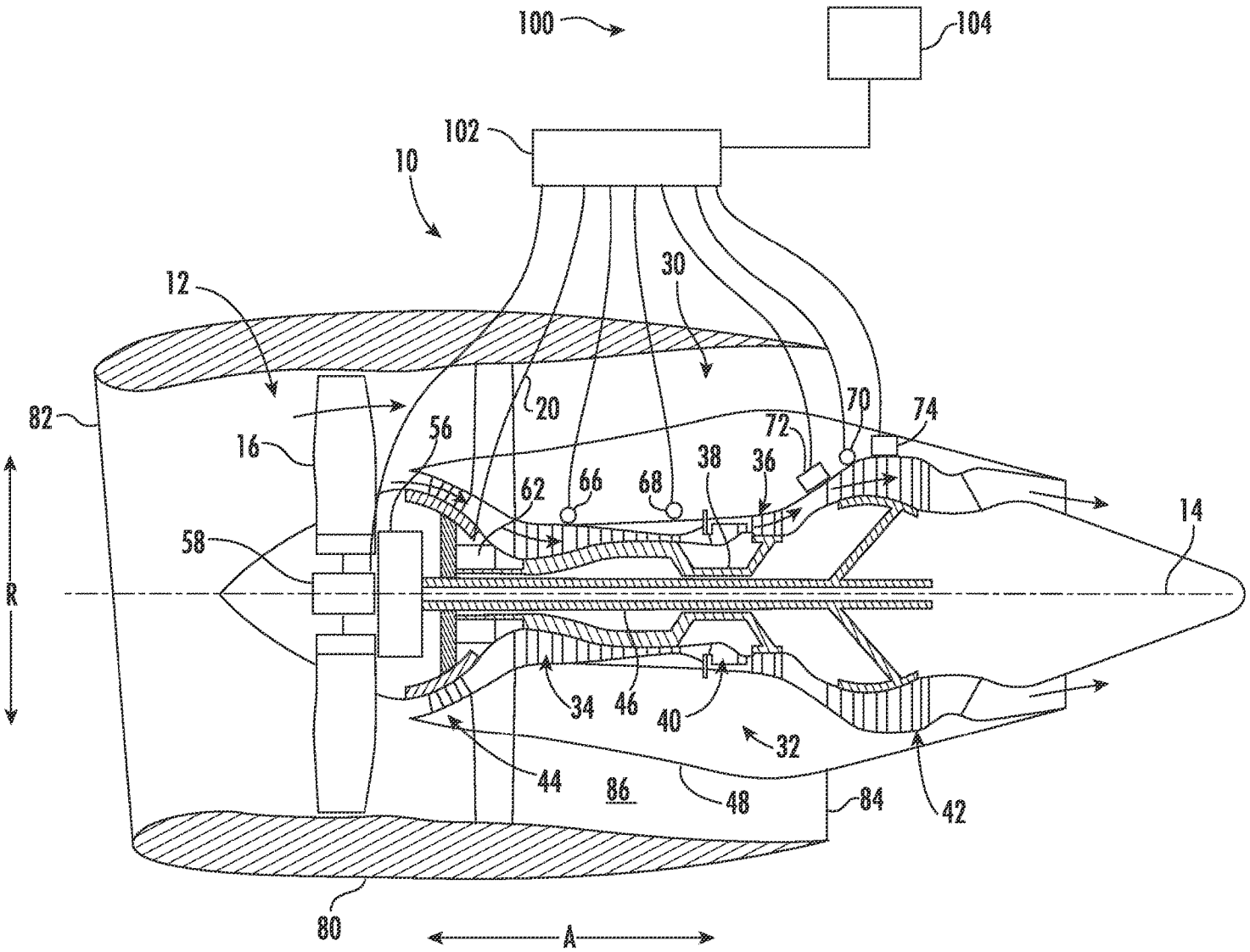
FIG. 2A is a schematic, cross-sectional view of a second gas turbine engine with an electric power system in accordance with another exemplary embodiment of the present disclosure.

FIG. 2A is a schematic, cross-sectional view of a second gas turbine engine in accordance with another exemplary embodiment of the present disclosure. For example, an engine 10 in accordance with another exemplary embodiment of the present disclosure is depicted in FIG. 2A. The exemplary embodiment of FIG. 2A may be configured in substantially the same manner as the exemplary engine 10 and electrical power system 100 described above with respect to FIGS. 1A-1B, and the same or similar reference numerals may refer to the same or similar parts. However, as will be appreciated, for the embodiment shown in FIG. 2A, engine 10 further includes a nacelle 80 (with inlet 82 and outlet 84) circumferentially surrounding at least in part rotor assembly 12 and turbomachine 30, defining a bypass passage 86 therebetween.

Here, FIG. 2A is provided to show a ducted fan arrangement of engine 10, with engine 10 including electric actuator system 100. Accordingly, the same or similar features of engine 10 with electrical actuation system 100 and their respective descriptions also apply to the embodiment shown in FIG. 2A of engine 10 with electrical actuation system 100.

Figure 2B:
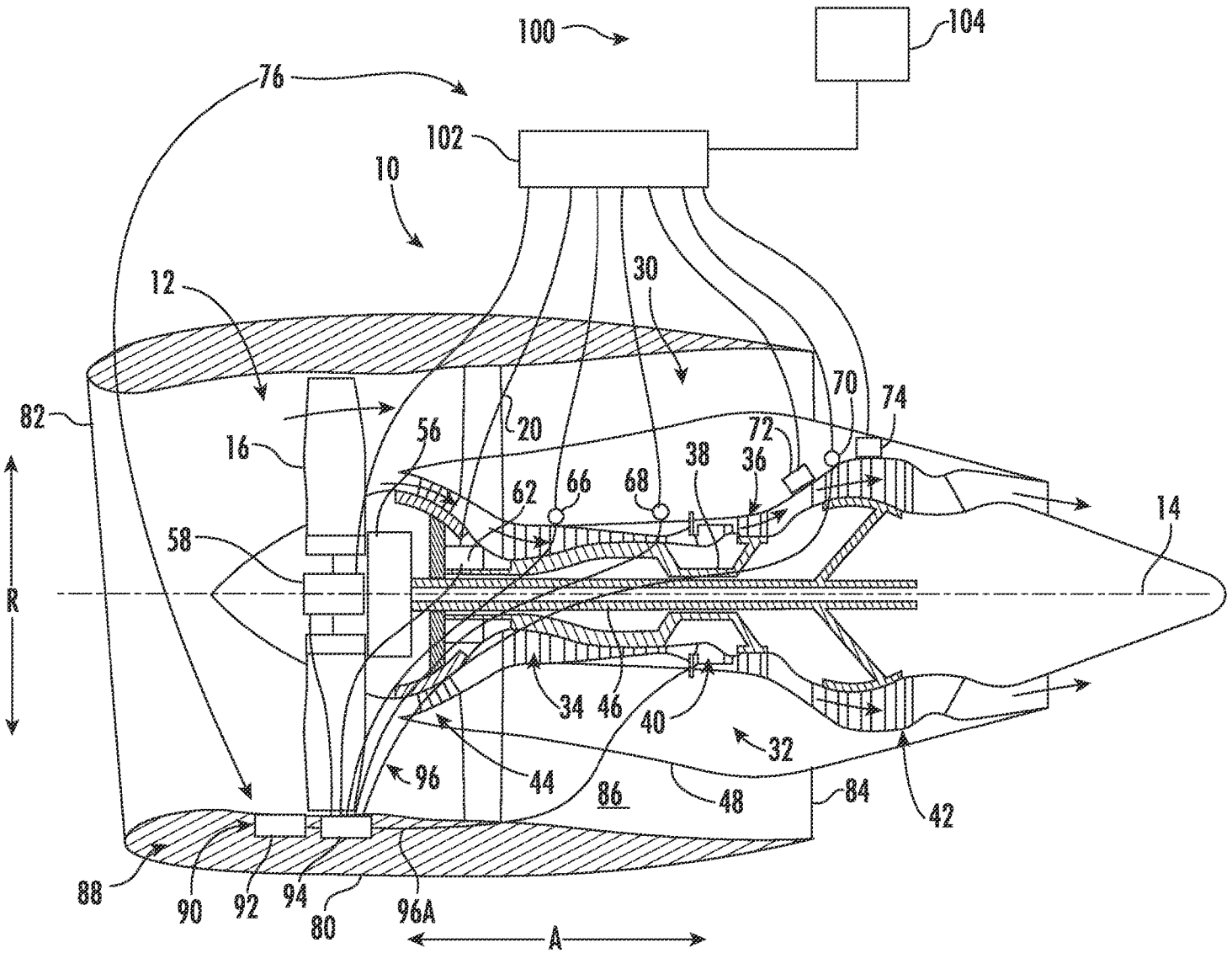
FIG. 2B is a schematic, cross-sectional view of the second gas turbine engine with a hybrid electric/hydraulic power system in accordance with another exemplary embodiment of the present disclosure.

Referring now to FIG. 2B, FIG. 2B is a schematic, cross-sectional view of engine 10 shown in FIG. 2A that additionally includes hybrid electric/hydraulic actuation system 88 with hydraulic actuation system 90 (including AGB 92, working fluid pump 94, and fluid lines 96) and electrical actuation system 100 (including load sharing bank 102 and power source 104). The exemplary embodiment of FIG. 2B may be configured in substantially the same manner as the exemplary engine 10 described above with respect to FIG. 2A, and the same or similar reference numerals may refer to the same or similar parts.

With the embodiment(s) shown in FIGS. 2A and 2B, a ducted fan arrangement is shown for engine 10. Similar to the embodiment(s) shown in FIGS. 1A and 1B, hydraulic actuation system 90 and/or electrical actuation system 100 can be used alone or in tandem to power any of actuators 58, 62, and 66-70 alone or in tandem as needed during operation of engine 10 (e.g., such as during a rejected takeoff event or when the compressor discharge pressure muscle force drops).

Figure 3:
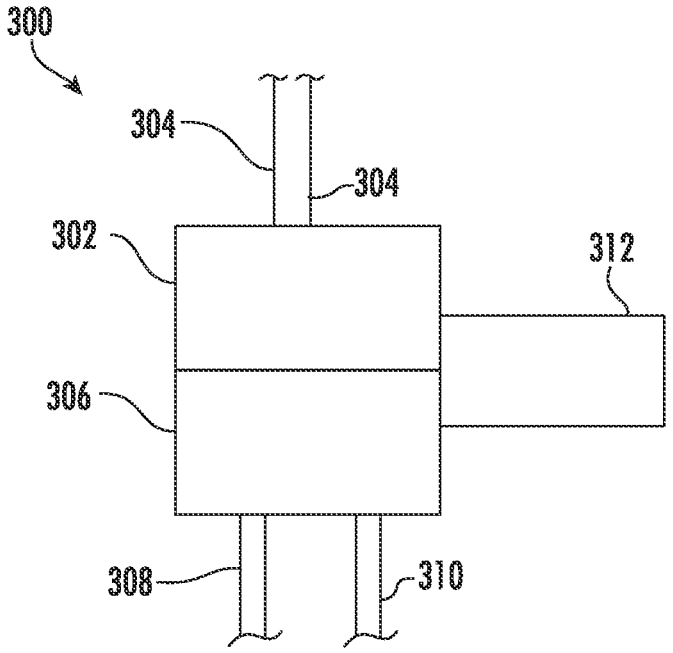
FIG. 3 is a simplified schematic view of a hybrid electric/hydraulic actuator in accordance with an exemplary embodiment of the present disclosure.

Referring now to FIG. 3, FIG. 3 is a simplified schematic view of hybrid electric/hydraulic actuator 300 and shows electric portion 302, lead lines 304, hydraulic portion 306, inlet line 308, outlet line 310, and actuating member 312. In this example, hybrid electric/hydraulic actuator 300 can be any of actuators 58, 62, and 66-70 provided in FIGS. 1A-2B above. Accordingly, the embodiment depicted herein, that of hybrid electric/hydraulic actuator 300, can apply to the other embodiments shown throughout and as depicted in FIGS. 1A-2B.

As shown in FIG. 3, hybrid electric/hydraulic actuator 300 includes both electric portion 302 and hydraulic portion 306. In one example, electric portion 302 receives electricity from load sharing bank 102 of electric actuation system 100 via lead lines 304. Likewise, hydraulic portion 306 can receive a working fluid from and deliver the working fluid to working fluid pump 94 via inlet line 308 and outlet line 310, respectively. During operation of hybrid electric/hydraulic actuator 300, actuation member is driven by either or both of electric portion 302 and hydraulic portion 306.

Hydraulic actuators can be driven by a pump with a limited amount of power that can be reduced when a supply pressure is reduced (e.g., fuel from a fuel pump during a power reduction mode of a gas turbine engine). Hybrid electric/hydraulic actuation system 88 (shown in FIGS. 1B and 2B) with hybrid electric/hydraulic actuator 300 (e.g., representative of any of actuators 58, 62, and 66-70) has a multitude of sources to draw power from to always provide the power needed to drive the actuation system(s) of engine 10.

It will be appreciated, however, that the hybrid electric/hydraulic actuator 300 is depicted schematically and is provided by way of example only. In other exemplary embodiments, the hybrid electric/hydraulic actuator 300 may have any suitable configuration for receiving power from a hydraulic system and an electric power source and converting such power received to movement of an actuation device. For example, in other exemplary embodiments, hybrid electric/hydraulic actuator 300 may include a hydraulic actuator coupled to the actuation device for moving the actuation device using hydraulic pressure, and a separate electric motor separately coupled to the actuation device for moving the actuation device using electric power. Other configurations are contemplated as well.

Figure 4:
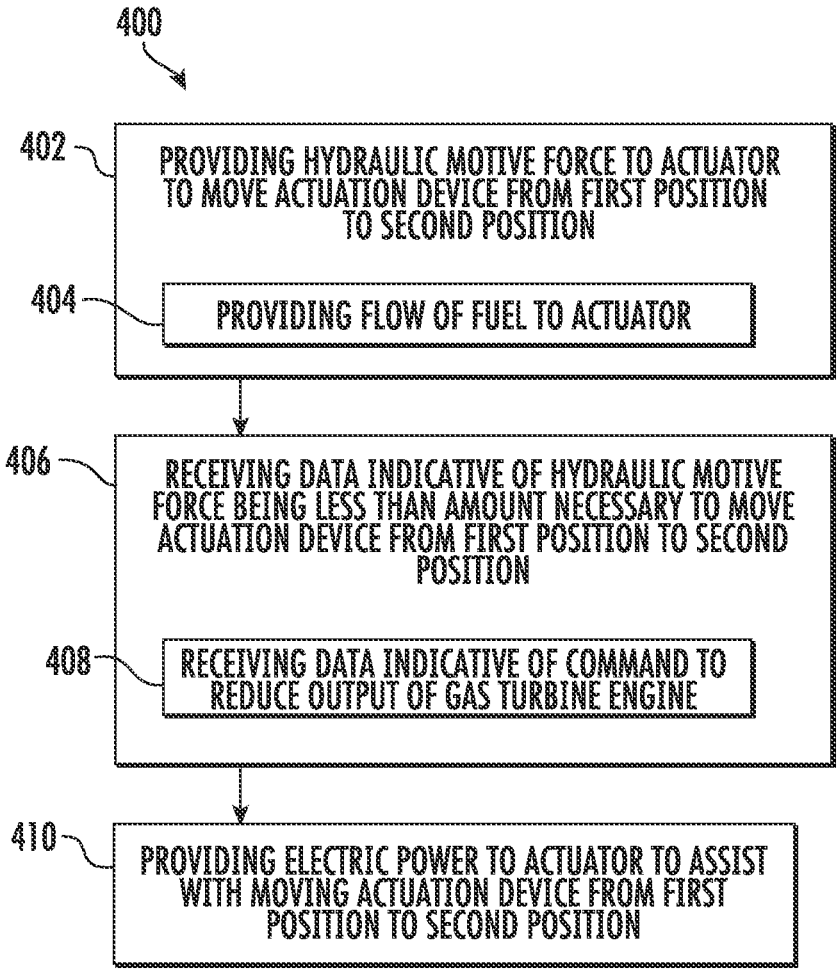
FIG. 4 is a flow diagram of a method for operating an actuator assembly.

Referring now to FIG. 4, a flow diagram is provided of an exemplary method 400 of changing a position of an actuation device in a gas turbine engine. The method 400 may be operable with one or more of the exemplary gas turbine engines described above, and one or more of the actuation devices (of actuator) described above.

The method 400 includes at (402) providing a hydraulic motive force to an actuator operationally coupled to the actuation device to move the actuation device from a first position to a second position. In certain exemplary aspects, the hydraulic system may be incorporated into the fuel system. In such an exemplary aspect, providing the hydraulic motive force to the actuator at (402) includes at (404) providing a flow of fuel to the actuator.

The method 400 further includes at (406) receiving data indicative of the hydraulic motive force being less than an amount necessary to move the actuation device from the first position to the second position. The data received at (406) may be any data indicative of a reduction in the pressure of the hydraulic system. For example, in certain exemplary aspects, receiving data indicative of the hydraulic motive force being less than the amount necessary to move the actuation device from the first position to the second position at (406) includes at (408) receiving data indicative of a command to reduce an output power of the gas turbine engine. This data may be data received from an engine controller (such as a Full Authority Digital Engine Controller, (FADEC), or any other suitable controller). Alternatively, the data may include pressure data from the hydraulic system, and/or operational data of the gas turbine engine (e.g., rotational speed, operational temperature and/or pressure, etc.).

Additionally, or alternatively, the data received at (406) may be data indicating that the actuation device has not moved to the second position within a desired amount of time, or that an aerodynamic force on the actuation device is greater than a motive force available from the hydraulic system.

The method 400 further includes at (410) providing electric power to the actuator to assist with moving the actuation device from the first position to the second position. Providing the electric power to the actuator at (410) may include providing electric power from a power source to the actuator, such as from an electric generator coupled to the gas turbine engine, an electric energy storage unit, an electric generator driven by a combustion engine other than the gas turbine engine, etc.

It will be appreciated that changing a position of the actuation device may involve or consist of causing the actuation device to expand, contract, flex or deform, in addition to or instead of linear or rotational motion such as shifting, rotating, or pivoting.

This written description uses examples to describe the disclosure, including the best mode, and also to enable any person skilled in the art to practice the disclosed embodiments, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses:

A gas turbine engine actuation system includes a gas turbine engine, an actuation device, an actuator, and a power source. The gas turbine engine includes a compressor section, a combustion section, a turbine section, and a rotating shaft. The actuation device is operable with the compressor section, combustion section, turbine section, or a combination thereof. The actuator is operationally coupled to the actuation device and includes an electric actuator configured to convert electrical current into mechanical power. The power source is configured to supply electrical current to the actuator.

The gas turbine engine actuation system of one or more of these clauses, further comprising a hydraulic system, and wherein the actuator comprises a hybrid hydraulic-electric actuator operable with the hydraulic system.

The gas turbine engine actuation system of one or more of these clauses, wherein the hydraulic system is a fuel delivery system.

The gas turbine engine actuation system of one or more of these clauses, further comprising: an accessory gearbox coupled to and driven by the gas turbine engine, wherein the hydraulic system is mechanically coupled to and driven by the accessory gearbox, the hydraulic system comprising: a working fluid; a working fluid pump disposed to pressurize the hydraulic system with the working fluid; and a fluid line that is fluidly connected to and extending between the working fluid pump and the actuator.

The gas turbine engine actuation system of one or more of these clauses, wherein the hybrid hydraulic-electric actuator is driven partially by electrical power and partially by the working fluid of the hydraulic system.

The gas turbine engine actuation system of one or more of these clauses, further comprising a generator coupled to the turbine section, wherein the power source includes the generator or is configured to receive electrical power from the generator.

The gas turbine engine actuation system of one or more of these clauses, further comprising a load sharing bank that is electrically connected to the actuator and to the power source, wherein the load sharing bank is configured to receive electrical current from the power source and supply the electrical current to the actuator.

The gas turbine engine actuation system of one or more of these clauses, further comprising: a first generator and a second generator, the first and second generators configured to supply electricity to the load sharing bank; wherein the turbine section comprises a low-pressure turbine section and a high-pressure turbine section; wherein the first generator is coupled to and draws power from the low-pressure turbine section; and wherein the second generator is coupled to and draws electricity from the high-pressure turbine section.

The gas turbine engine actuation system of one or more of these clauses, wherein the actuation device comprises at least one of a variable bleed valve, a variable stator vane, a compressor discharge pressure bleed valve, or a turbine clearance control system.

The gas turbine engine actuation system of one or more of these clauses, wherein the power source comprises an external power source disconnected from any rotational elements of the gas turbine engine.

A hybrid electric/hydraulic actuation system for a gas turbine engine includes an actuation device operable with a section of the gas turbine engine, a hybrid electric/hydraulic actuator, a hydraulic actuation system, and an electric actuation system. The hybrid electric/hydraulic actuator is operationally coupled to the actuation device and is driven partially by electrical power and partially by a working fluid. The hydraulic actuation system includes the working fluid, the working fluid pump disposed to pressurize the hydraulic actuation system with the working fluid, and a fluid line that is fluidly connected to and extending between the working fluid pump and the hybrid electric/hydraulic actuator. The electric actuation system includes a power source configured to supply electrical current to the hybrid electric/hydraulic actuator.

The hybrid electric/hydraulic actuation system of one or more of these clauses, wherein the electric actuation system further comprises a load sharing bank that is electrically connected to the actuator and to the power source, wherein the load sharing bank is configured to receive electrical current from the power source and supply the electrical current to the hybrid electric/hydraulic actuator.

The hybrid electric/hydraulic actuation system of one or more of these clauses, wherein the electric actuation system further comprises a generator configured to generate electricity from the gas turbine engine and supply the generated electricity to the load sharing bank.

The hybrid electric/hydraulic actuation system of claim one or more of these clauses, further comprising: wherein the generator comprises a first generator and a second generator; wherein the first generator is coupled to and draws power from a low-pressure turbine section of the gas turbine engine; and wherein the second generator is coupled to and draws electricity from a high-pressure turbine section of the gas turbine engine.

The hybrid electric/hydraulic actuation system of claim one or more of these clauses, wherein the actuation device comprises at least one of a variable bleed valve, a variable stator vane, a compressor discharge pressure bleed valve, and a turbine clearance control system.

The hybrid electric/hydraulic actuation system of claim one or more of these clauses, wherein the power source comprises an external power source disconnected from any rotational elements of the gas turbine engine.

A method of changing a position of an actuation device in a gas turbine engine includes providing a hydraulic motive force to an actuator operationally coupled to the actuation device to move the actuation device from a first position to a second position. Data indicative of the hydraulic motive force being less than an amount necessary to move the actuation device from the first position to the second position is received. Electric power is provided to the actuator to assist with moving the actuation device from the first position to the second position. The method of one or more of these clauses, wherein the actuation device comprises at least one of a variable bleed valve, a variable stator vane, a compressor discharge pressure bleed valve, or a turbine clearance control system.

The method of one or more of these clauses, wherein providing the hydraulic motive force to the actuator comprises providing a flow of fuel to the actuator.

The method of claim one or more of these clauses, wherein receiving data indicative of the hydraulic motive force being less than the amount necessary to move the actuation device from the first position to the second position comprises receiving data indicative of a command to reduce an output power of the gas turbine engine.

We claim:

1. A gas turbine engine actuation system comprising:

a gas turbine engine comprising:

a compressor section;

a combustion section disposed in fluid communication with and downstream from the compressor section;

a turbine section disposed in fluid communication with and downstream from the compressor section; and a rotating shaft extending axially along a centerline of the gas turbine engine;

an actuation device operable with the compressor section, the combustion section, the turbine section, or a combination thereof;

a hybrid hydraulic-electric actuator operationally coupled to the actuation device, wherein the hybrid hydraulic-electric actuator comprises an electric actuator configured to convert electrical current into a first mechanical power to mechanically drive the actuation device, wherein the hybrid hydraulic-electric actuator further comprises a hydraulic actuator configured to convert fluidic pressure into a second mechanical power to mechanically drive the actuation device; and a power source configured to supply electrical current to the electric actuator;

wherein the hybrid hydraulic-electric actuator is configurably coupled to the actuation device such that the actuation device is driven at the same time by both the first mechanical power from the electric actuator and the second mechanical power from the hydraulic actuator.

2. The gas turbine engine actuation system of claim 1, further comprising a hydraulic system, and wherein the hybrid hydraulic-electric actuator is operable with the hydraulic system.

3. The gas turbine engine actuation system of claim 2, wherein the hydraulic system is a fuel delivery system.

4. The gas turbine engine actuation system of claim 2, further comprising:

an accessory gearbox coupled to and driven by the gas turbine engine, wherein the hydraulic system is mechanically coupled to and driven by the accessory gearbox, the hydraulic system comprising:

a working fluid;

a working fluid pump disposed to pressurize the hydraulic system with the working fluid; and a fluid line that is fluidly connected to and extending between the working fluid pump and the hybrid hydraulic-electric actuator.

5. The gas turbine engine actuation system of claim 1, further comprising a generator coupled to the turbine section, wherein the power source includes the generator or is configured to receive electrical power from the generator.

6. The gas turbine engine actuation system of claim 1, further comprising a load sharing bank that is electrically connected to the electric actuator and to the power source, wherein the load sharing bank is configured to receive electrical current from the power source and supply the electrical current to the actuator.

7. The gas turbine engine actuation system of claim 6, further comprising:

a first generator and a second generator, the first and second generators configured to supply electricity to the load sharing bank;

wherein the turbine section comprises a low-pressure turbine section and a high-pressure turbine section;

wherein the first generator is coupled to and draws power from the low-pressure turbine section; and wherein the second generator is coupled to and draws electricity from the high-pressure turbine section.

8. The gas turbine engine actuation system of claim 1, wherein the actuation device comprises at least one of a variable bleed valve, a variable stator vane, a compressor discharge pressure bleed valve, or a turbine clearance control system.

9. The gas turbine engine actuation system of claim 1, wherein the power source comprises an external power source disconnected from any rotational elements of the gas turbine engine.

10. A hybrid electric/hydraulic actuation system for a gas turbine engine, the hybrid electric/hydraulic actuation system comprising:

an actuation device operable with a section of the gas turbine engine;

a hybrid electric/hydraulic actuator that is driven partially by electrical power and partially by a working fluid, wherein the hybrid electric/hydraulic actuator is operationally coupled to the actuation device;

a hydraulic actuation system comprising:

the working fluid;

a working fluid pump disposed to pressurize the hydraulic actuation system with the working fluid to create a first mechanical work from the hybrid electric/hydraulic actuator; and a fluid line that is fluidly connected to and extending between the working fluid pump and the hybrid electric/hydraulic actuator; and an electric actuation system comprising:

a power source configured to supply electrical current to the hybrid electric/hydraulic actuator to create a second mechanical work;

wherein the hybrid electric/hydraulic actuator is configurably coupled to the actuation device such that the actuation device is driven at the same time by both the first mechanical work from the hybrid electric/hydraulic actuator and the second mechanical work from the hybrid electric/hydraulic actuator.

11. The hybrid electric/hydraulic actuation system of claim 10, wherein the electric actuation system further comprises a load sharing bank that is electrically connected to the hybrid electric/hydraulic actuator and to the power source, wherein the load sharing bank is configured to receive electrical current from the power source and supply the electrical current to the hybrid electric/hydraulic actuator.

12. The hybrid electric/hydraulic actuation system of claim 10, wherein the electric actuation system further comprises a generator configured to generate electricity from the gas turbine engine and supply the generated electricity to a load sharing bank.

13. The hybrid electric/hydraulic actuation system of claim 12, further comprising:

wherein the generator comprises a first generator and a second generator;

wherein the first generator is coupled to and draws power from a low-pressure turbine section of the gas turbine engine; and wherein the second generator is coupled to and draws electricity from a high-pressure turbine section of the gas turbine engine.

14. The hybrid electric/hydraulic actuation system of claim 10, wherein the actuation device comprises at least one of a variable bleed valve, a variable stator vane, a compressor discharge pressure bleed valve, and a turbine clearance control system.

15. The hybrid electric/hydraulic actuation system of claim 10, wherein the power source comprises an external power source disconnected from any rotational elements of the gas turbine engine.

* * * * *